US007075388B2

(12) United States Patent
Rogozine et al.

(10) Patent No.: US 7,075,388 B2
(45) Date of Patent: Jul. 11, 2006

(54) CERAMIC RF TRIPLEXER

(75) Inventors: Alexandre Rogozine, Albuquerque, NM (US); Brian Matthews, Louisville, KY (US); David R. Heine, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 75 days.

(21) Appl. No.: 10/851,412

(22) Filed: May 21, 2004

(65) Prior Publication Data

US 2005/0024163 A1 Feb. 3, 2005

Related U.S. Application Data

(60) Provisional application No. 60/472,688, filed on May 22, 2003.

(51) Int. Cl.
*H01P 5/12* (2006.01)
*H01P 1/213* (2006.01)

(52) U.S. Cl. ..... 333/134; 333/202; 333/207; 333/222; 333/206; 343/909

(58) Field of Classification Search ..... 333/134, 333/202, 207, 219, 206, 203, 222; 343/909
See application file for complete search history.

(56) References Cited

U.S. PATENT DOCUMENTS

| | | | | |
|---|---|---|---|---|
| 4,742,562 | A | 5/1988 | Kommrusch | |
| 5,109,536 | A | 4/1992 | Kommrusch | |
| 5,239,279 | A * | 8/1993 | Turunen et al. | 333/134 |
| 5,241,693 | A | 8/1993 | Kim et al. | |
| 5,374,906 | A * | 12/1994 | Noguchi et al. | 333/134 |
| 5,731,746 | A | 3/1998 | Heine et al. | |
| 6,809,612 | B1 * | 10/2004 | Bloom et al. | 333/134 |
| 6,879,222 | B1 * | 4/2005 | Vangala et al. | 333/134 |
| 6,900,150 | B1 * | 5/2005 | Jacquin et al. | 501/139 |
| 2002/0050873 | A1 | 5/2002 | Tsunoda et al. | |
| 2002/0132597 | A1 | 9/2002 | Peterzell et al. | |
| 2003/0008667 | A1 | 1/2003 | Forrester | |
| 2003/0046137 | A1 | 3/2003 | Spiegel et al. | |
| 2004/0174236 | A1 * | 9/2004 | Matthews | 333/206 |

FOREIGN PATENT DOCUMENTS

| | | |
|---|---|---|
| EP | 1 001 479 | 5/2000 |

* cited by examiner

*Primary Examiner*—Tan Ho
*Assistant Examiner*—Chuc Tran
(74) *Attorney, Agent, or Firm*—Steven Weseman; Daniel J. Deneufbourg

(57) ABSTRACT

A monoblock ceramic triplexer for connection to an antenna, a transmitter, a receiver and a GPS receiver is described. The triplexer includes a solid, monolithic core of dielectric material defining a plurality of through-holes extending between top and bottom surfaces. The surfaces of the core present a pattern of metallized and unmetallized areas including a relatively expansive metallized area, a transmitter coupling area, first and second receiver coupling areas spaced, an antenna coupling metallized area and an unmetallized area circumscribing at least one of the openings on the top surface. The antenna coupling metallized area includes a top surface extension towards the first receiver coupling area, and the expanded metallized area includes a top surface extension between adjacent resonator through-holes.

29 Claims, 7 Drawing Sheets

CERAMIC RF TRIPLEXER

CROSS-REFERENCE TO RELATED APPLICATION

This application claims the benefit of the filing date of U.S. Provisional application Ser. No. 60/472,688, filed on 22 May 2003, which is explicitly incorporated by reference, as are all references cited therein.

TECHNICAL FIELD

This invention relates to dielectric block filters for radio-frequency signals, and in particular, to monoblock multi-passband filters.

BACKGROUND

A variety of wireless radio signal communication devices rely on antenna duplexing filters. Such filters provide band-pass filtering both for incoming signals read by radio receiver elements and for outgoing signals generated by transmitter elements.

For wireless handsets, antenna duplexers in the form of conductor-coated ceramic monoblocks have gained widespread acceptance. In the basic ceramic block duplexer design, resonators are formed by typically cylindrical passages, called through-holes, extending through a parallelepiped (i.e. rectangular) block. The block is substantially plated with a conductive material (i.e. metallized) on all but one of its six (outer) sides and on the inside walls formed by the resonator holes.

One of the two opposing sides containing through-hole openings is not fully metallized, but instead bears a metallization pattern designed to couple input and output signals through the series of resonators. This patterned side is conventionally labeled the top of the block, though the "top" designation may also be applied to the side opposite the surface mount contacts when referring to a filter in the board-mounted orientation. In some designs, the pattern may extend to sides of the block, where input/output electrodes are formed.

The reactive coupling between adjacent resonators is affected, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

While early wireless handsets were designed to operate with a single wireless network standard, handsets are conventionally designed to operate with multiple networks. The various wireless networks worldwide operate over channels at differing frequencies. Conventional wireless handsets include filtering for communication signals in several different frequency passbands. A single antenna duplexer is rarely sufficient to provide the necessary handset filtering.

More recently, government initiatives have begun to require that wireless network operators be able to track and report the geographic location of handsets operating in the network. To provide this location tracking service, wireless telecommunications operators and designers have focused on the global positioning systems (GPS). In order to track location with GPS, wireless handsets must include additional receiver circuitry and related signal filtering at another frequency, e.g. 1575.42 MHz.

When combined, the frequency requirements of GPS-based location tracking and multi-network compatibility create particularly complicated filtering schemes for wireless telephone handsets. Handsets designed for use with multiple networks and GPS location tracking may include several filters and related antenna switching subcircuits.

There remains a need for more versatile filters that can simplify handset filtering schemes by reducing the number of physical components required for filtering multiple standards. This invention pertains to a ceramic block filter that provides three or more passbands in a single block, and is suitable for use with GPS filtering requirements.

SUMMARY

Filters according to present invention include a solid, monolithic core of dielectric material having first and second ends, and top and bottom surfaces. The core defines a plurality of through-holes each extending between an opening on the top surface and an opening on the bottom surface. Present on the core is a pattern of metallized and unmetallized areas. The pattern includes a relatively expansive metallized area for providing a reference potential, a transmitter coupling metallized area, a first receiver coupling metallized area, a second receiver coupling metallized area, an antenna coupling metallized area and an unmetallized area circumscribing at least one of the openings on the top surface.

The relatively expansive area extends contiguously from the sidewall of the through-holes towards both the top surface and bottom surface of the core. The expansive area continues from within the through-holes over the bottom surface and the side surfaces of the core.

The first receiver coupling metallized area is spaced apart from the transmitter coupling area along the length of the block. The second receiver coupling metallized area is positioned between the transmitter and the first receiver coupling areas, and the antenna coupling metallized area is positioned between the transmitter and the second receiver coupling areas.

The antenna coupling area has a resonator bypass portion extending towards the first receiver area. The bypass portion aids reception of signals in the desired receive passband at the first receiver coupling area.

The plurality of through-holes and the pattern of metallized and unmetallized areas on the core together define a series of resonators. The portion of the core and resonators present from the antenna coupling area to a first end of the core form a transmit branch. Likewise, the portion of the core and resonators present from the antenna coupling area to a second end of the core form a receive branch. The transmitter coupling area is present in the transmit branch and positioned towards the first end of the core, while the first receiver coupling area is present in the receive branch and positioned toward the second, opposing end of the core.

Present between the antenna coupling area and the first receiver coupling area is a second receiver coupling area.

BRIEF DESCRIPTION OF THE FIGURES

In the Figures.

DETAILED DESCRIPTION OF THE PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
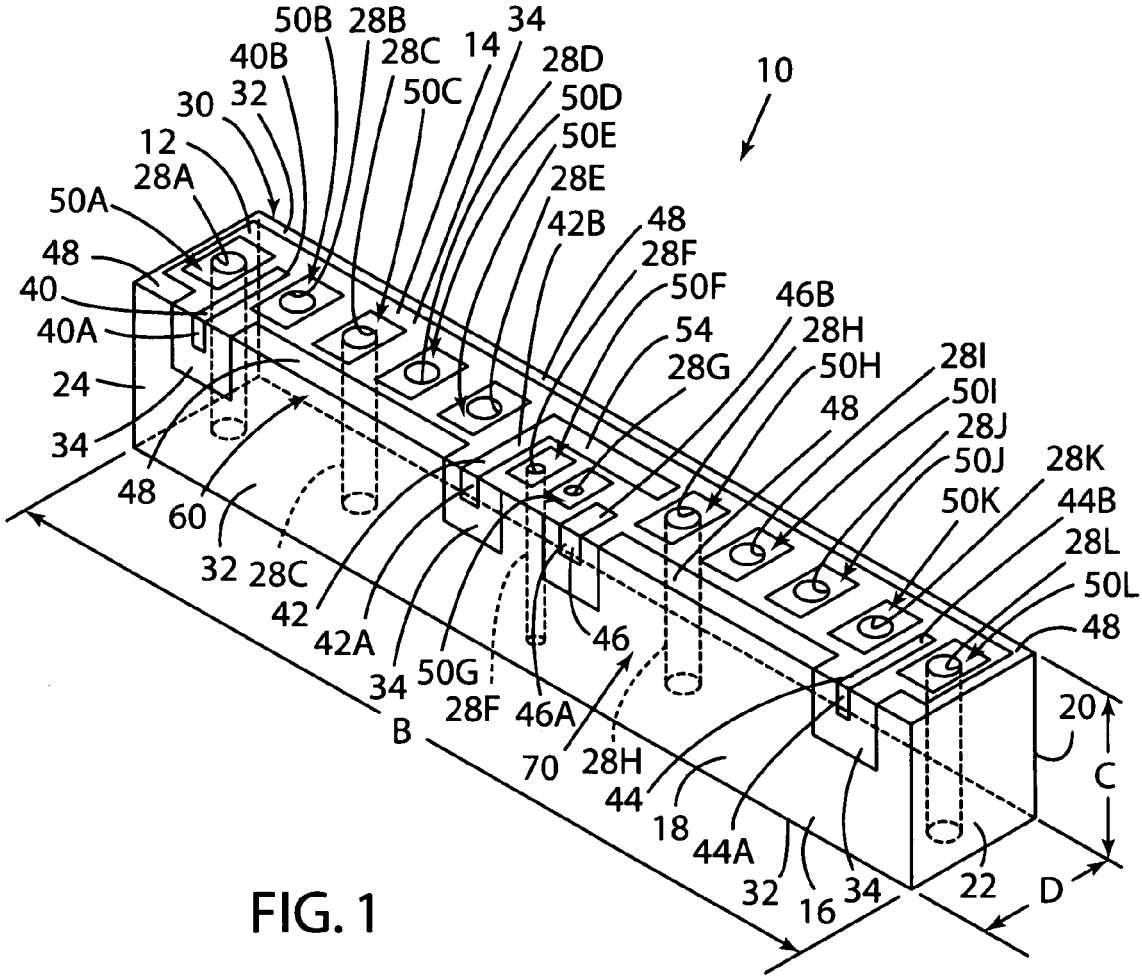
FIG. 1 is an enlarged, simplified perspective view of a triplexing filter according to the present invention.
Figure 2:
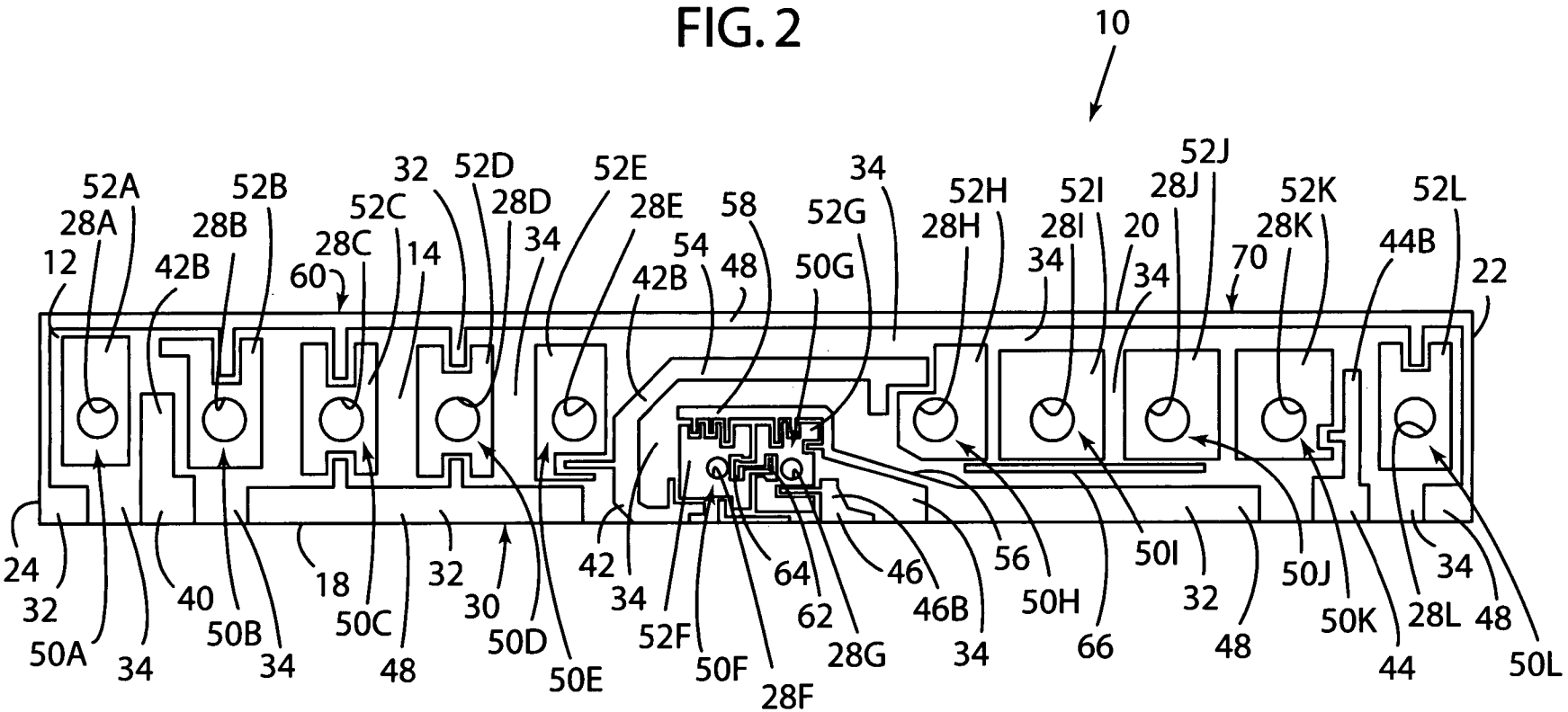
FIG. 2 is an enlarged top view of a triplexing filter revealing details of the pattern of metallized and unmetallized areas on the top surface.

Referring to FIGS. 1 and 2, a filter 10 includes an elongate, parallelepiped (or "box-shaped") core of ceramic dielectric material 12. Core 12 has three sets of opposing side surfaces: a top 14 and a bottom 16, opposing long sides 18 and 20, and opposing narrow ends or sides 22 and 24. Core 12 defines a series of through-hole passageways 28A, 28B, 28C, 28D, 28E, 28F, 28G, 28H, 281, 28J, 28K and 28L, which each extend between openings on top surface 14 and bottom surface 16.

Dimensions for filter 10 are identified in FIG. 1 with reference letter B for length, C for width and D for height.

Core 12 is rigid and is preferably made of a ceramic material selected for mechanical strength, dielectric properties, plating compatibility, and cost. The preparation of suitable dielectric ceramics is described in U.S. Pat. No. 6,107,227 to Jacquin et al., U.S. Pat. Nos. 6,242,376 and 6,559,083, the disclosures of which are hereby incorporated by reference to the extent they are not inconsistent with the present teachings. Core 12 is preferably prepared by mixing separate constituents in particulate form (e.g., $Al_2O_3$, $TiO_2$, $Zr_2O_3$) with heating steps followed by press molding and then a firing step to react and inter-bond the separate constituents.

Filter 10 includes a pattern of metallized and unmetallized areas (or regions) 30, as shown in greater detail in FIG. 2. Pattern 30 includes an expansive, relatively wide area of metallization 32 and an unmetallized area 34. Pattern 30 also includes multiple input-output coupling metallized areas 40, 42, 44 and 46. Specifically, pattern 30 has a transmitter coupling area 40, an antenna input-output coupling area 42, a first receiver coupling area 44*a and a second receiver coupling area* 46.

Each coupling area 40, 42, 44 and 46 has a surface mounting portion 40A, 42A, 44A and 46A on side surface 18 and a corresponding portion 40B, 42B, 44B and 46B on top surface 14. Pads 40A, 42A, 44A and 46A are provided for connecting filter 10 to other circuit elements of an electronic device in a surface-mount configuration. Accordingly, the label height is applied to distance between sides 18 and 20, rather than the distance between what has been labeled top 14 and bottom 16, because the term height is a reference to surface-mounting height, i.e. board profile, of filter 10.

Expansive metallized area 32 covers portions of top surface 14 and side surface 18, and substantially all of bottom surface 16, side surfaces 20, 22 and 24 as well as the sidewalls of through-holes 28. Area 32 serves as a D.C. ground, i.e. a reference potential. Expansive metallized area 32 extends contiguously from within the resonator holes 28 towards both top surface 14 and bottom surface 18. Top surface 14 includes metallized margin areas 48 which are also part of expansive metallized area 32. Core 12 and pattern 30 together form the series of through-hole resonators 50A, 50B, 50C, 50D, 50E, 50F, 50G, 50H, 50I, 50J, 50K and 50L. Resonator pads 52A, 52B, 52C, 52D, 52E, 52F, 52G, 52H, 52I, 52J, 52K and 52L (FIG. 2) are located on top surface 14 and are a portion of metallized area 32 connected to metallization on the sidewalls of through-holes 28.

Transmit coupling area 40 and first receiver coupling area 44 are spaced apart from antenna electrode 42 in opposite directions along the length B of core 12. Antenna coupling area 42 is positioned between transmitter coupling area 40 and first receiver coupling area 44. Second receiver coupling area 46 is positioned between first receiver coupling area 44 and antenna coupling area 42.

As used herein to describe the relative position of coupling areas and through-holes, the term "between" is a reference to the substantial alignment of features of the filter over the length B of the block between end 22 and end 24. Furthermore, the alignment of features described using the term "between" may include a reasonable amount of overlap and/or offset. For example, the position of through-hole 28A is between surface mount pad 40A and end 24 even though pad 40A is offset (on side 18) from the series of through-holes 28.

For ease of description, filter 10 can be divided at antenna coupling area 42 into two branches (or sections) of resonators 28, a transmitter branch 60 and a receiver branch 70. Transmitter branch 60 extends between antenna coupling area 42 and end 24, while receiver branch 70 extends in the opposite direction between antenna coupling area 42 and end 22. Transmitter branch 60 includes a series of resonators 50A, 50B, 50C, 50D and 50E. Receiver branch 70 includes resonators 50F, 50G, 50H, 50I, 50J, 50K and 50L.

Transmitter branch 60 includes a trap resonator 50A. Trap resonators, such as resonator 50A, are configured to produce a zero, or attenuation pole, in the transfer function of the filter. To serve as a frequency trap, the resonator is located adjacent transmitter connection electrode 40 but opposite the array of spaced-apart resonators which extend between antenna electrode 42 and transmitter electrode 40. More specifically, trap resonator 50A is positioned between transmitter electrode 40 and end 24 of core 12. Likewise, receiver branch 70 includes a trap resonator 50L positioned between first receive electrode 44 and end 22 of core 12.

A key feature of the present invention is that antenna coupling area 42 includes a resonator bypass portion (or extension) 54 extending towards end 22. Portion 54 extends parallel to the pair of centrally located through-hole resonators 50F and 50G. In a preferred embodiment, bypass portion 54 extends to a position adjacent a third resonator 50H.

Another key feature of the present invention is an extension 56 of the relatively expansive metallization area 32. Extension 56 extends from a border portion 48 of area 32 between resonators 50G and 50H, and terminates in a portion 58 adjacent to resonators 50F and 50G.

The pair of resonators 50F and 50G present between antenna coupling area 42 and second receiver area 46 are offset from the line defined by the axes of the other resonators 50A, 50B, 50C, 50D, 50E, 50H, 50I, 50J, 50K and 50L. Resonator pads 52F and 52G include complimentary intruding extensions 62 and 64, respectively, to enhance capacitive coupling between these adjacent resonators.

Pattern 30 also includes an isolated metallized area 66 on top surface 14 in the shape of a bar or strip extending over the length of core 12 adjacent to resonator pads 52H, 52I and 52J.

The unmetallized area 34 is present on portions of top surface 14 and side surface 18. Unmetallized area 34 substantially surrounds (or circumscribes) the resonator pads 52A, 52B, 52C, 52D, 52E, 52F, 52G, 52H, 52I, 52J, 52K and 52L. Unmetallized area 34 also circumscribes transmitter coupling area 40, antenna coupling area 42, first receiver coupling area 44, second receiver coupling area 46 and strip-shaped area 66. In a preferred embodiment as illustrated in FIGS. 1 and 2, pattern 30 includes a single contiguous unmetallized area. Alternate embodiments including multiple isolated unmetallized areas are also contemplated.

The metallized areas of pattern 30 preferably comprise a coating of one or more layers of a conductive metal. A silver-bearing conductive layer is presently preferred. Suitable thick film silver-bearing conductive pastes are commercially available from The Dupont Company's Microcircuit Materials Division.

The surface-layer pattern of metallized and unmetallized areas 30 on core 12 is preferably prepared by providing a rigid core of dielectric material, including through-holes, to predetermined dimensions. The outer surfaces and through-hole sidewalls are coated with one or more metallic film layers by dipping, spraying or plating. The pattern of metallized and unmetallized areas is then preferably completed by computer-automated laser ablation of designated areas on core 12. This laser ablation approach results in unmetallized areas which are not only free of metallization but also recessed into the surfaces of core 12 because laser ablation removes both the metal layer and a slight portion of the dielectric material. In a preferred process for using a scanning-laser ablation to create the unmetallized areas, the unmetallized area is recessed into the core to a depth in the range of about 7 to about 30 microns.

Alternatively, selected surfaces of the fully metallized core precursor are removed by abrasive forces such as particle blasting, resulting in one or more unmetallized surfaces. The pattern of metallized and unmetallized areas is then completed by pattern printing with thick film metallic paste.

Filters according to the present invention are optionally equipped with a metallic shield positioned across top surface 14. For a discussion of metal shield configurations, see U.S. Pat. No. 5,745,018 to Vangala. The filters are typically later soldered to a printed circuit board that contains an RF transmitter, receiver and an antenna as in a cell phone, for example.

EXAMPLE 1

A filter was simulated according to the embodiment shown in FIGS. 1 and 2 with the design parameters specified in Table I, below.

TABLE I

| | |
|---|---|
| Filter length (side 24 to side 22) | 27 mm |
| Filter board height (side 18 to 20) | 4.6 mm |

TABLE I-continued

| | |
|---|---|
| Filter width (side 14 to side 16) | 5.5 mm |
| Outgoing (transmit) signal passband | 1850 to 1910 MHz |
| First receive coupling area signal passband | 1930 to 1990 MHz |
| Second receive coupling area signal passband | 1573.42 to 1577.42 MHz |

Figure 3:
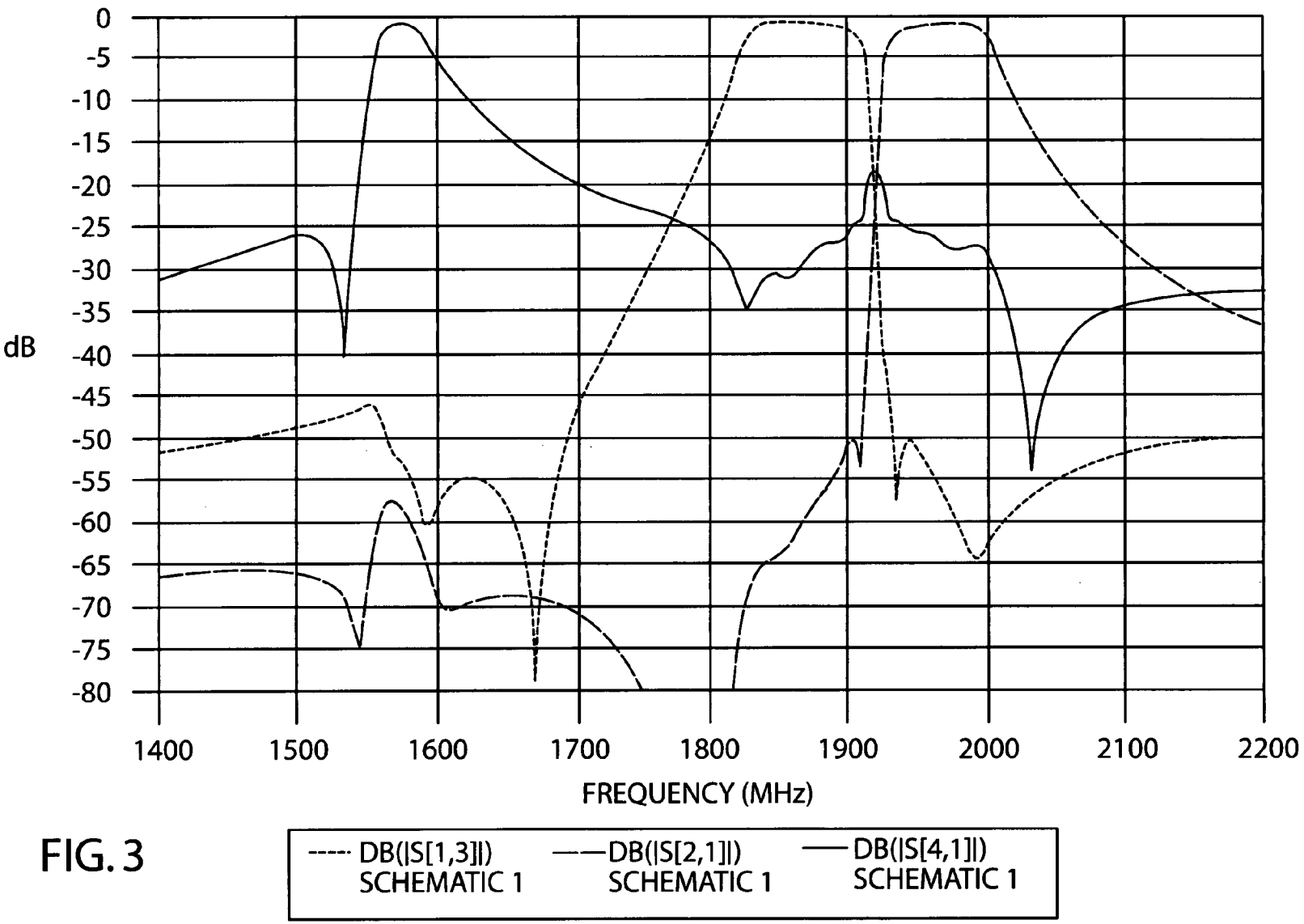
FIG. 3 is a graph of insertion loss (i.e. attenuation) versus frequency for a transmit passband of a triplexing filter according to the present invention.
Figure 4:
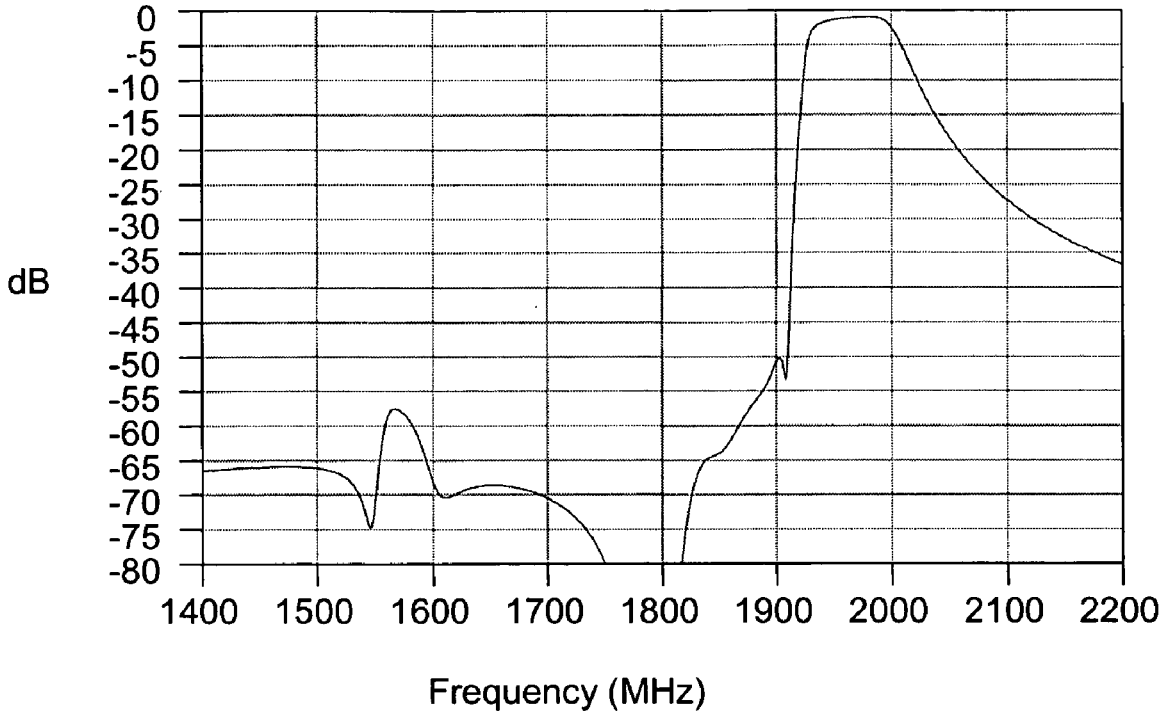
FIG. 4 is a graph of insertion loss versus frequency for a PCS receive passband of a triplexing filter according to the present invention.
Figure 5:
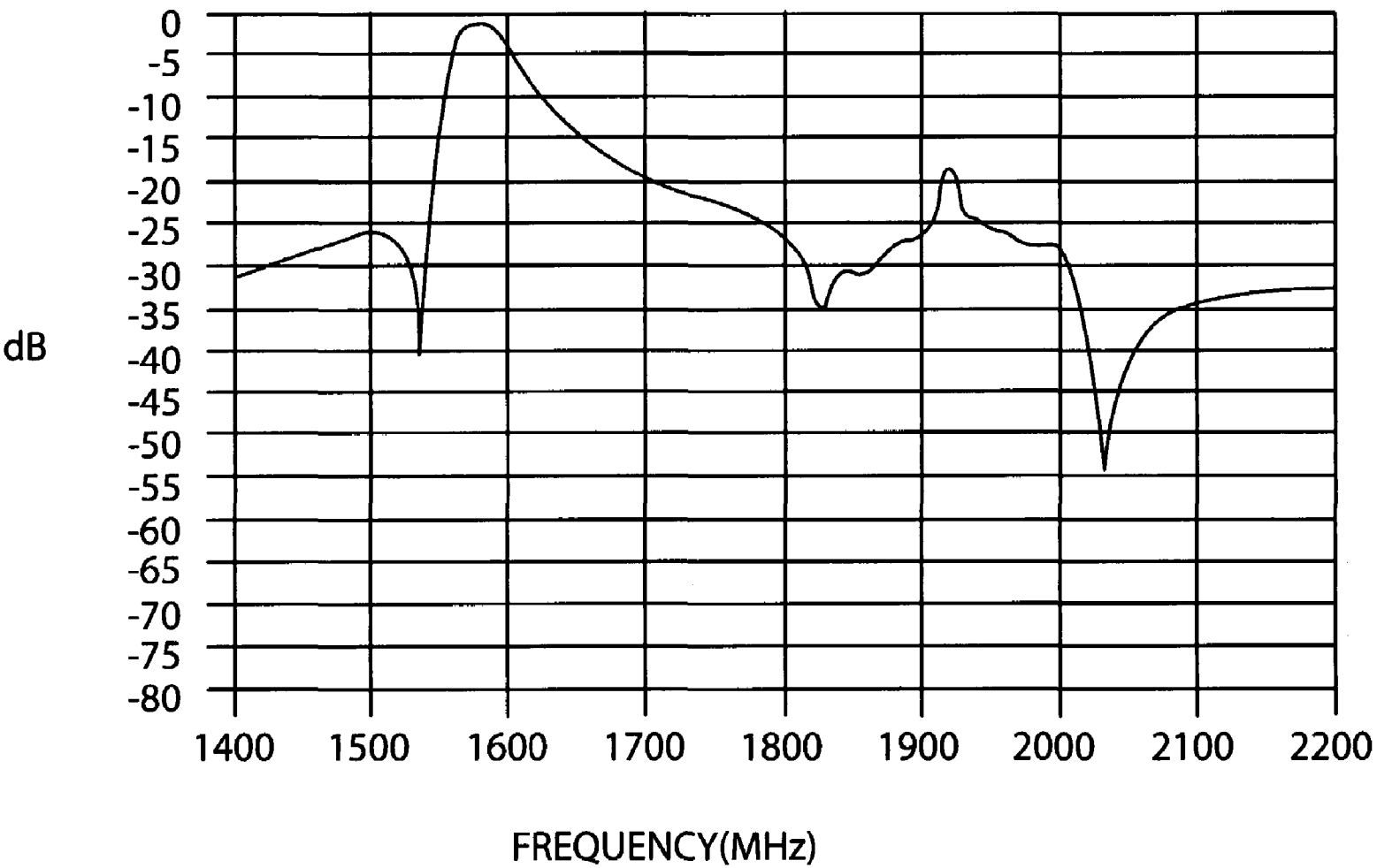
FIG. 5 is a graph of insertion loss versus frequency for a second receive passband of a triplexing filter according to the present invention.

The example filter was simulated using Microwave Office, Applied Wave Research, Inc. (El Segundo, Calif.). FIGS. 3 through 5 are plots of transmission scattering parameter (S-parameters) data for the triplexer according to FIGS. 1 and 2.

S-parameters are ratios of reflected and transmitted traveling waves measured at specified component connection points. An $S_{21}$ data point or plot is a measure of insertion loss, a ratio of an output signal at an output connection to an input signal at an input connection, at one or a range of input signal frequencies. The "21" subscript designation on S is a reference to the port numbers of the device under test. Accordingly, the subscript "21" is used to indicate a transmission measurement.

For a discussion of Scattering Parameters and associated test standards and equipment, please consult the following references: Anderson, Richard W. "S-Parameter Techniques for Faster, More Accurate Network Design," *Hewlett-Packard Journal,* vol. 18, no. 6, February 1967; Weinert, "Scattering Parameters Speed Design of High Frequency Transistor Circuits," *Electronics,* vol. 39, no. 18, Sep. 5, 1986; or Bodway, "Twoport Power Flow Analysis Using Generalized Scattering Parameters," *Microwave Journal,* vol. 10, no. 6, May 1967.

FIG. 3 is a type S21 Scattering Parameter result from the simulation for the transmit section, i.e. transmit coupling area 40 to antenna coupling area 42. The filter exhibited a maximum (20 log S) insertion loss for the desired transmit frequency band of about 3.2 dB. FIG. 4 is a type S21 Scattering Parameter result from the simulation of signal reception between the antenna coupling area 42 and the first receiver coupling area 44. The filter exhibited a maximum (20 log S) insertion loss for the desired receive frequency band of about 3.3 decibels (dB). FIG. 5 is a type S21 Scattering Parameter result from the simulation of signal reception between the antenna coupling area 42 and the second receiver coupling area 46. The filter exhibited a maximum (20 log S) insertion loss for this second receive frequency band of about 1.1 dB.

The simulated triplexer exhibited a significant improvement in attenuation at the target frequencies and only minor signal losses in the transmit and receive passbands. The triplexer provides transmit band, primary receive band and secondary receive band filtering in a single monoblock with low maximum insertion loss in the passband as well as a sharp transition to the stopbands.

Alternate Embodiment

Figure 6:
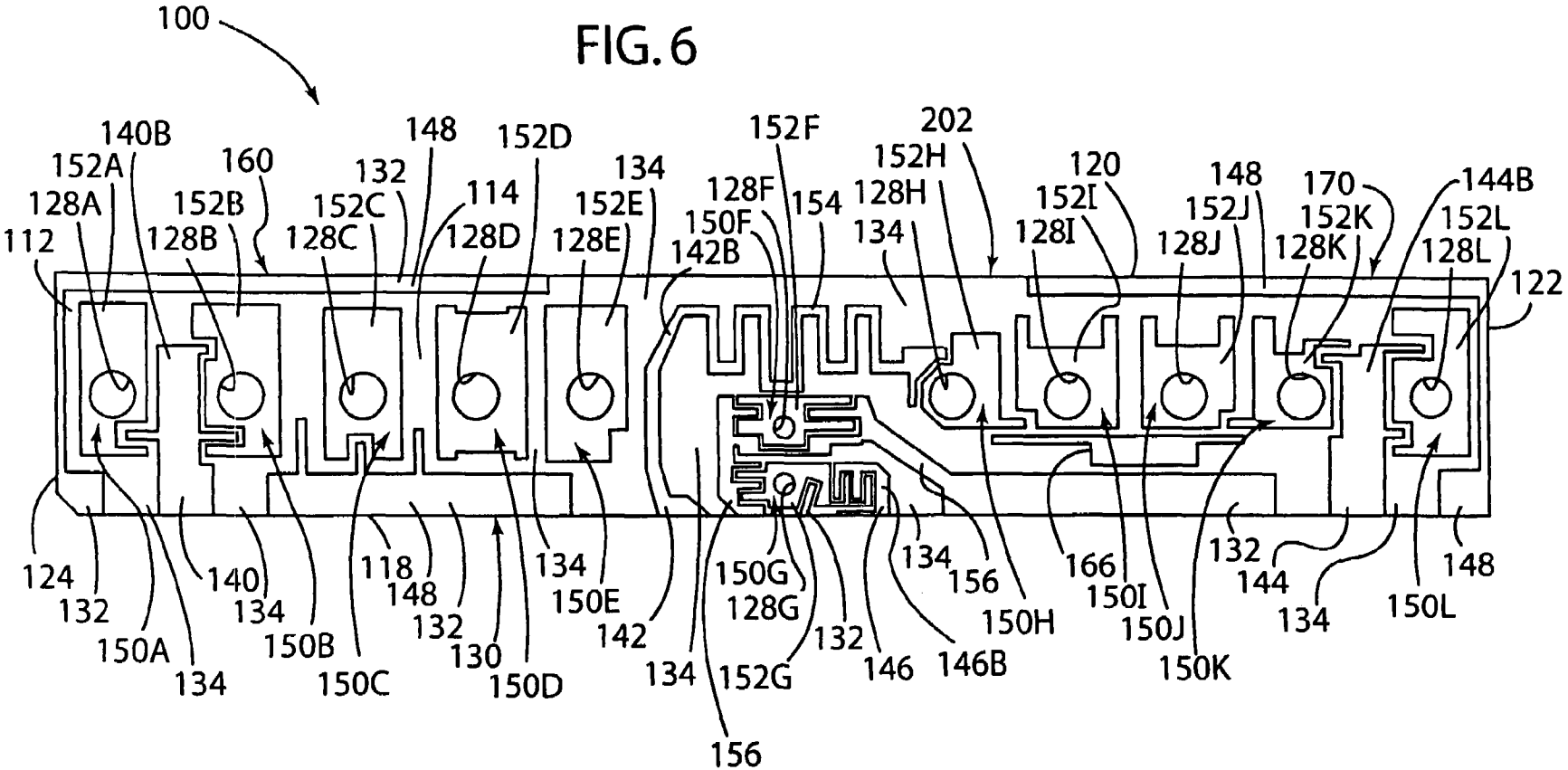
FIG. 6 is an enlarged top view for alternative embodiment of a triplexing filter according to the present invention.

Shown in FIG. 6 is an enlarged view of the top surface pattern of metallized and unmetallized areas for an alternate embodiment 100 of the present invention. The triplexer embodiment 100 shown in FIG. 6 shares a number of features with filter 10 (which is shown in FIGS. 1 and 2). Several features common to both filter 100 and filter 10 are not separately illustrated for filter 100. Such duplicate features described below are identified by special reference back to FIGS. 1 and 2. For example, FIG. 1 is relied upon to show the following features that are common between filter 10 and filter 100, bottom surface 16 and surface mounting pads 40A, 42A, 44A and 46A. The surface mounting pads 40A, 42A, 44A and 46A of FIG. 1 also correspond to the coupling areas 140, 142, 144 and 146 of FIG. 6, respectively.

Triplexing filter 100 includes an elongate, parallelepiped (or "box-shaped") core of ceramic dielectric material 112. Core 112 has three sets of opposing side surfaces: a top 114 and a bottom 16 (FIG. 1), opposing long sides 118 and 120, and opposing narrow ends or sides 122 and 124. Core 112 defines a series of through-hole passageways 128A, 128B, 128C, 128D, 128E, 128F, 128G, 128H, 128I, 128J, 128K and 128L, which each extend between openings on top surface 114 and bottom surface 116.

Core 112 is similar to core 12. Filter 100 includes a pattern of metallized and unmetallized areas (or regions) 130. Pattern 130 includes an expansive, relatively wide area of metallization 132 and an unmetallized area 134. Pattern 130 also includes multiple input-output coupling metallized areas 140, 142, 144 and 146. Specifically, pattern 130 has a transmitter coupling area 140, an antenna input-output coupling area 142, a first receiver coupling area 144 a and a second receiver coupling area 146.

Each coupling area 140, 142, 144 and 146 has a surface mounting portion 40A, 42A, 44A and 46A (FIG. 1) on side surface 118 and a corresponding portion 140B, 142B, 144B and 146B on top surface 114. Pads 40A, 42A, 44A and 46A (FIG. 1) are provided for connecting filter 100 to other circuit elements of an electronic device in a surface-mount configuration.

Expansive metallized area 132 covers portions of top surface 114 and side surface 118, and substantially all of bottom surface 116, side surfaces 120, 122 and 124 as well as the sidewalls of through-holes 128. Area 132 serves as a D.C. ground, i.e. a reference potential. Expansive metallized area 132 extends contiguously from within the resonator holes 128 towards both top surface 114 and bottom surface 116. Top surface 114 includes metallized margin areas 148 which are also part of expansive metallized area 132. Core 112 and pattern 130 together form the series of through-hole resonators 150A, 150B, 150C, 150D, 150E, 150F, 150G, 150H, 150I, 150J, 150K and 150L. Resonator pads 152A, 152B, 152C, 152D, 152E, 152F, 152G, 152H, 152I, 152J, 152K and 152L are located on top surface 114 and are a portion of metallized area 132 connected to metallization on the sidewalls of through-holes 128.

Transmit coupling area 140 and first receiver coupling area 144 are spaced apart from antenna electrode 142 in opposite directions along the length of core 112. Antenna coupling area 142 is positioned between transmitter coupling area 140 and first receiver coupling area 144. Second receiver coupling area 146 is positioned between first receiver coupling area 144 and antenna coupling area 142.

For ease of description, filter 100 can be divided at antenna coupling area 142 into two branches (or sections) of resonators 128, a transmitter branch 160 and a receiver branch 170. Transmitter branch 160 extends between antenna coupling area 142 and end 124, while receiver branch 170 extends in the opposite direction between antenna coupling area 142 and end 122. Transmitter branch 160 includes a series of resonators 150A, 150B, 150C, 150D and 150E. Receiver branch 170 includes resonators 150F, 150G, 150H, 150I, 150J, 150K and 150L.

Transmitter branch 160 includes a trap resonator 150A. Trap resonators, such as resonator 150A, are configured to produce a zero, or attenuation pole, in the transfer function of the filter. To serve as a frequency trap, the resonator is located adjacent transmitter connection electrode 140 but opposite the array of spaced-apart resonators which extend between antenna electrode 142 and transmitter electrode 140. More specifically, trap resonator 50A is positioned between transmitter electrode 140 and end 124 of core 112. Likewise, receiver branch 170 includes a trap resonator 150L positioned between first receive electrode 144 and end 122 of core 112.

A feature of the present invention is that antenna coupling area 142 includes a resonator bypass portion (or extension) 154 extending towards end 122. Portion 154 has a winding or sinuous shape and extends adjacent to through-hole resonators 150F. In a preferred embodiment, bypass portion 154 extends to a position adjacent a third resonator 150H.

Another feature of the present invention is an extension 156 of the relatively expansive metallization area 132. Extension 156 extends from area 132 between resonators 150F and 150H. Extension 156 forms a loop that circumscribes the opening of through-hole 128G and therefore resonator 150G.

The pair of resonator pads 152F and 152G present between antenna coupling area 142 and second receiver area 146 have an orientation that is rotated ninety degrees with respect to those shown in the embodiment of FIG. 2. Resonators 150F and 150G and the pads 152F and 152G thereof are located between resonator bypass portion 154 and side 118. More specifically, the series of resonator pads present in the transmitter branch 128A–128E has a substantially rectilinear orientation. The series of resonator pads 152F–152G have a transverse orientation with respect to the transmitter series of resonator pads 152A–152E. In a preferred embodiment, the series of resonator pads 152F and 152G have a substantially perpendicular orientation with respect to the transmitter series of resonator pads 152A–152E.

Pattern 130 also includes an isolated metallized area 166 on top surface 114 in the shape of a bar or strip extending over the length of core 12 adjacent to resonator pads 152H, 152I and 152J.

The unmetallized area 134 is present on portions of top surface 114 and side surface 118. Unmetallized area 114 substantially surrounds (or circumscribes) the resonator pads 152A, 152B, 152C, 152D, 152E, 152F, 152G, 152H, 152I, 152J, 152K and 152L. Unmetallized area 134 also circumscribes transmitter coupling area 140, antenna coupling area 142, first receiver coupling area 144, second receiver coupling area 146 and strip-shaped area 166. Pattern 130 can include a single contiguous unmetallized area or can be multiple isolated unmetallized areas.

The manufacturing of triplexer 100 is similar to triplexer 10.

EXAMPLE 2

A filter was simulated according to the embodiment shown in FIG. 6 with the design parameters specified in Table II, below.

TABLE II

| | |
|---|---|
| Filter length (side 124 to side 122) | 27 mm |
| Filter board height (side 118 to 120) | 4.6 mm |
| Filter width (side 114 to side 116) | 5.5 mm |
| Outgoing (transmit) signal passband | 1850 to 1910 MHz |

TABLE II-continued

| | |
|---|---|
| First receive coupling area signal passband | 1930 to 1990 MHz |
| Second receive coupling area signal passband | 1573.42 to 1577.42 MHz |

Figure 7:
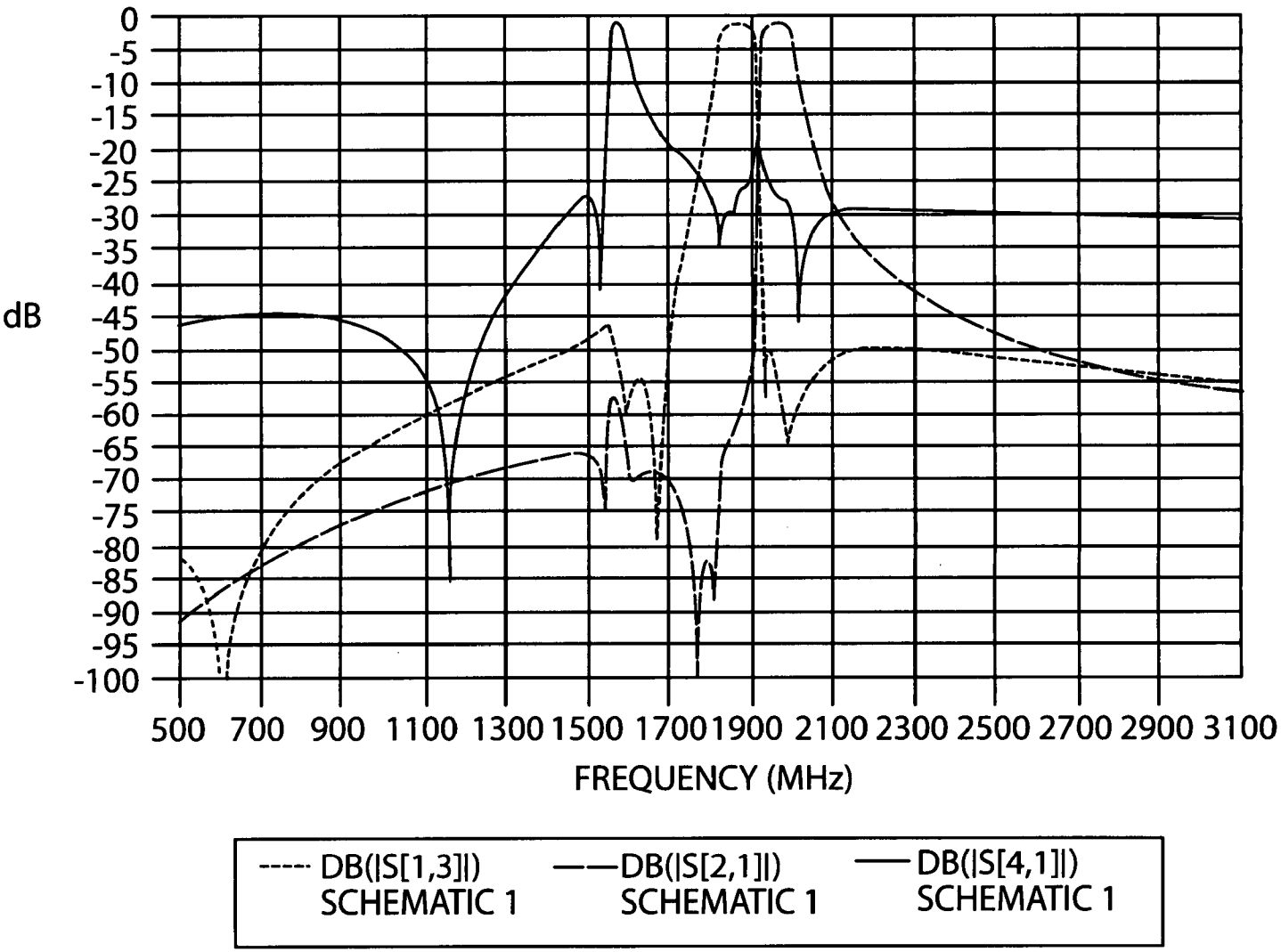
FIG. 7 is a graph of insertion loss versus frequency for a transmit passband, a PCS receive passband and a second receive passband of a triplexing filter according to the present invention.

The example filter was simulated using Microwave Office, Applied Wave Research, Inc. (El Segundo, Calif.). FIG. 7 shows plots of transmission scattering parameter (S-parameters) data for the triplexer according to FIGS. 6. FIG. 7 includes S21 Scattering Parameter results from the simulation for the transmit section and the first and second receive sections. The filter exhibited a maximum (20 log S) insertion loss for the desired transmit frequency band of about 3.2 dB. The filter exhibited a maximum (20 log S) insertion loss for the desired receive frequency band of about 3.3 decibels (dB). The filter exhibited a maximum (20 log S) insertion loss for this second receive frequency band of about 1.1 dB.

The simulated triplexer exhibited a significant improvement in attenuation at the target frequencies and only minor signal losses in the transmit and receive passbands. The triplexer provides transmit band, primary receive band and secondary receive band filtering in a single monoblock with low maximum insertion loss in the passband as well as a sharp transition to the stopbands.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

We claim:

1. A communication signal filter comprising:

a monolithic core of dielectric material having a first end, a second end, a top surface, a bottom surface and defining a plurality of through-holes each extending between an opening on the top surface and an opening on the bottom surface; and a pattern of metallized and unmetallized areas on the core including, a relatively expansive metallized area;

a transmitter coupling metallized area and a first receiver coupling metallized area spaced apart from one another along a length of the block core, a second receiver coupling metallized area between the transmitter and the first receiver coupling areas, an antenna coupling metallized area positioned between transmitter and the second receiver coupling areas, the antenna coupling area having a resonator bypass portion extending towards the first receiver area, the unmetallized area circumscribing at least one of the openings on the top surface.

2. The filter according to claim 1 wherein the unmetallized area is contiguous and circumscribes at least one of the openings on the top surface and each of the transmitter, first receiver, second receiver and antenna coupling areas.

3. The filter according to claim 1 wherein the core is a parallelepiped.

4. The filter according to claim 1 wherein the pattern of metallized and unmetallized areas and said plurality of through-holes together define a trap resonator.

5. The filter according to claim 1 wherein the pattern of metallized areas defines a plurality of resonator pads on the top surface surrounding the plurality of through-holes including a first series of resonator pads with a substantially rectilinear orientation extending from the transmitter metallized area and the antenna metallized area and a second series of resonator pads having a transverse orientation with respect to the first series.

6. The filter according to claim 5 wherein the transverse orientation is a perpendicular orientation.

7. The filter according to claim 1 with a maximum linear dimension of at most about 27 millimeters.

8. The filter according to claim 1 with a surface mount height of at most about 27 millimeters.

9. The filter according to claim 1 wherein said each one of the plurality of through-holes has side walls and said expansive area of metallization is present on the bottom surface and each of said side walls of each said through-hole.

10. The filter according to claim 1 wherein the core has four side surfaces including the first end and the second end, and each said coupling area extends over portions of said top surface and one of said side surfaces.

11. The filter according to claim 1 wherein at least one of said plurality of through-holes is positioned between a side surface of said core and said transmitter coupling area to serve as a trap resonator.

12. The filter according to claim 1 wherein at least one of said series of through-holes is positioned between one of the ends and the receiver coupling area to serve as a trap resonator.

13. The filter according to claim 1 wherein the unmetallized area is created by laser ablation of a fully metallized core of dielectric material.

14. The filter according to claim 1 wherein the pattern includes an unmetallized area recessed from the top surface of the core block.

15. The filter according to claim 1 wherein the top surface has a metallization pattern as shown in FIG. 2.

16. The filter according to claim 1 wherein the top surface has a metallization pattern as shown in FIG. 6.

17. The filter according to claim 1 wherein the relatively expansive metallized area has an inward extension onto the top surface.

18. The filter according to claim 17 wherein the inward extension extends between an adjacent pair of said openings on said top surface.

19. The filter according to claim 17 wherein the inward extension extends from a position adjacent a first resonator of the plurality of through-hole resonators to a position adjacent a second resonator of the plurality of through-hole resonators.

20. An antenna triplexer filter comprising:

a monolithic core of dielectric material having a first end, a second end, a top surface, a bottom surface and defining a plurality of through-holes each extending between an opening on the top surface and an opening on the bottom surface; and an antenna connection metallized area on the core;

a transmitter branch extending between an antenna electrode and a first end of the core;

a receiver branch extending between the antenna electrode and a second end of the core, the second end opposing the first end;

a transmitter connection metallized area spaced apart from the antenna electrode along a length of the core and positioned in the transmitter branch;

a first receiver connection metallized area spaced apart from the antenna electrode along the length of the core and positioned in the receiver branch;

a second receiver connection metallized area spaced between the antenna connection metallized area and the first receiver connection metallized area along a length of the core and positioned in the receiver branch; and a relatively expansive metallized area for providing a reference potential.

21. The triplexer according to claim 20 wherein the antenna connection area has a resonator bypass portion extending into said receiver branch.

22. The triplexer according to claim 21 wherein the resonator bypass portion is elongate and rectangular in shape.

23. The triplexer according to claim 21 wherein the resonator bypass portion has a sinuous shape.

24. The triplexer according to claim 21 wherein the resonator bypass portion extends from a position adjacent a first resonator of the plurality of through-hole resonators to a position adjacent a second resonator of the plurality of through-hole resonators.

25. The triplexer according to claim 20 wherein the relatively expansive metallized area defines a first series of through holes resonator pads in the transmitter branch with a substantially rectilinear orientation and the relatively expansive metallized area further defines a second series of through-hole resonator pads having a transverse orientation with respect to the first series.

26. The triplexer according to claim 20 wherein at least one of the through-hole resonators is configured to be a signal trapping resonator.

27. The filter according to claim 20 wherein the relatively expansive metallized area has an inward extension onto the top surface.

28. The filter according to claim 20 wherein the relatively expansive metallized area has an inward extension onto the top surface and the inward extension occupies space between adjacent resonators.

29. The filter according to claim 20 wherein the relatively expansive metallized area has an inward extension onto the top surface and the inward extension circumscribes an opening of at least one of the plurality of through-holes.

* * * * *